US005524402A

United States Patent [19]

Sykes

[11] Patent Number: 5,524,402

[45] Date of Patent: Jun. 11, 1996

[54] PARTITION STRUCTURES AND FRAME ELEMENTS THEREFOR

[76] Inventor: Christopher C. Sykes, 211 Queens Quay West, Apartment 902, Toronto, Ontario, Canada, M5J 2M6

[21] Appl. No.: 173,257

[22] Filed: Dec. 27, 1993

Related U.S. Application Data

[63] Continuation of Ser. No. 737,145, Jul. 29, 1991, abandoned, which is a continuation-in-part of Ser. No. 484,520, Feb. 26, 1990, Pat. No. 5,062,246, which is a continuation-in-part of Ser. No. 271,920, Nov. 16, 1988, Pat. No. 4,905,428.

[51] Int. Cl.[6] ..... F04B 2/82

[52] U.S. Cl. ..... 52/243.1; 52/126.3; 52/241

[58] Field of Search ..... 52/126.3, 243.1, 52/243, 241, 242, 238.1, 262, 127.6, 127.7, 127.8

[56] References Cited

U.S. PATENT DOCUMENTS

| | | | |
|---|---|---|---|
| 3,504,465 | 4/1970 | Brinker | 52/282.3 |
| 3,566,559 | 3/1971 | Dickson | 52/241 |
| 3,782,048 | 1/1974 | Corman | 52/738 |
| 4,056,903 | 11/1977 | Guarnere | 52/126.4 |
| 4,103,463 | 8/1978 | Dixon | 52/241 |
| 4,204,375 | 5/1980 | Good | 52/239 |
| 4,245,442 | 1/1981 | Durham | 52/126.4 |
| 4,356,672 | 11/1982 | Beckman et al. | 52/36 |
| 4,391,069 | 7/1983 | Vermillion | 52/126.4 |
| 4,391,073 | 7/1983 | Mollenkopf et al. | 52/241 |
| 4,406,101 | 9/1983 | Heidmann | 52/220 |
| 4,535,577 | 8/1985 | Tenser et al. | 52/221 |
| 4,631,881 | 11/1986 | Charman | 52/220 |
| 4,689,930 | 9/1987 | Menchetti | 52/277 |

FOREIGN PATENT DOCUMENTS

| | | | |
|---|---|---|---|
| 0177639 | 4/1986 | European Pat. Off. . | |
| 1336293 | 7/1963 | France | 52/282.3 |

*Primary Examiner*—Michael Safavi
*Attorney, Agent, or Firm*—Ridout & Maybee

[57] ABSTRACT

Partition structure has a rigid rectangular frame and rigid rectangular panels received in openings on opposite sides of the frame, with a small clearance between the edges of the panel and the frame. At corners, adjacent frames are connected with extruded connectors having arms joined adjacent side edges of the side rails of the frames. The arms define a space in the middle of the area of intersection of the side rails projected outwardly so as to leave space through which electrical cables and the like may be run. There are also disclosed frame elements and partition structures arranged for stacking of modular frame elements one on another, for sealing and supporting of glass panels to form windows, for attachment of the upper end of a partition to a ceiling, and for levelling of a frame element on an uneven floor.

9 Claims, 11 Drawing Sheets

14
111b
227
111a
111
112a
112
112b
211a
211b
161
191
113
3
6
9
5

PARTITION STRUCTURES AND FRAME ELEMENTS THEREFOR

This application is a continuation of application Ser. No. 07/737,145, filed Jul. 29, 1991, which is a continuation-in-part of Ser. No. 07/484,520, filed Feb. 26, 1990, now U.S. Pat. No. 5,062,246, which is a continuation-in-part of Ser. No. 07/271,920, filed Nov. 16, 1988, now U.S. Pat. No. 4,905,428.

The invention relates to partition structures and to elements for use in their construction. More especially, although not exclusively, it relates to partition structures for use in offices.

Known partition structures have employed corner posts to which partition members have been connected at points at which it is desired to form an angle or corner in the structures. Often, however it is desired to run electrical power or telecommunication wiring through the interior of the partition structures. The corner posts obstruct such wiring and limit the freedom of arrangement of the supply of the wiring to and between adjacent partition structures.

In a first aspect of the present invention, there is provided a corner partition structure comprising first and second rectangular frame elements each having at least one side rail engaging releasable connection means, and characterized by a corner connector comprising a short length of an extrusion comprising a plurality of arms disposed at right angles to one another, said arms being joined adjacent side edges of said side rails and defining a space in the middle of the area of intersection of said side rails projected outwardly, each arm extending adjacent a respective side rail and connecting releasably with the connection means. The arms define a space between them through which electrical cables may be run, so that wiring may be passed vertically through the cavity at the corner.

This greatly increases the capability of the structure to have wiring arranged through it.

In other aspects of the present invention there are provided frame elements and partition structures particularly adapted to enable convenient and secure stacking of modular frame elements one on another, connection of capping plates on a top side of the partition, attachment of the upper end of a partition to a ceiling, or levelling of a frame element on an uneven floor. Examples of the above forms of frame elements and partitions in accordance with the invention are described in more detail hereinafter with reference to the accompanying drawings in which.

Figure 1:
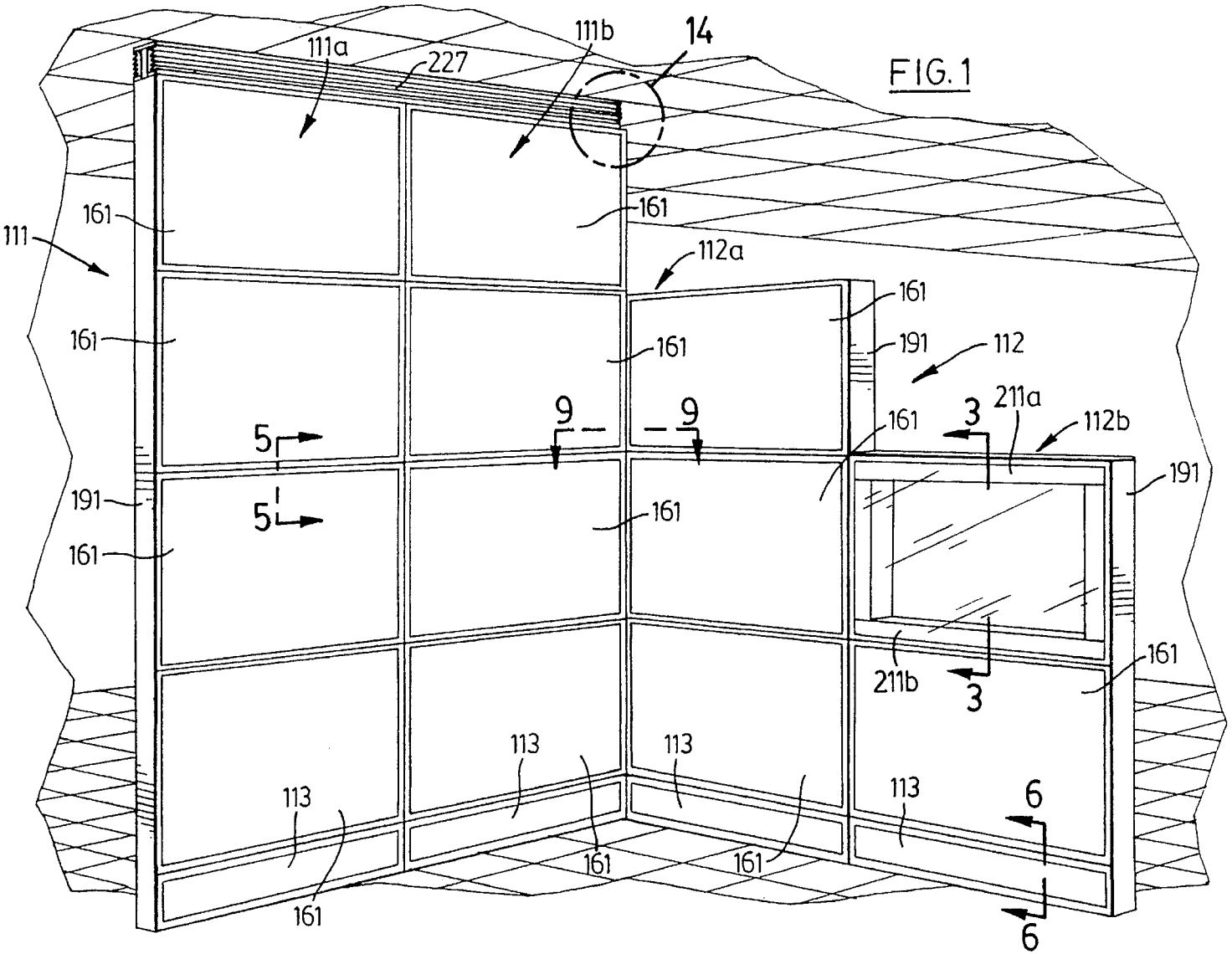
FIG. 1 shows a perspective view of a corner partition structure formed from modular frame elements and facing panels in accordance with the invention.
Figure 3:
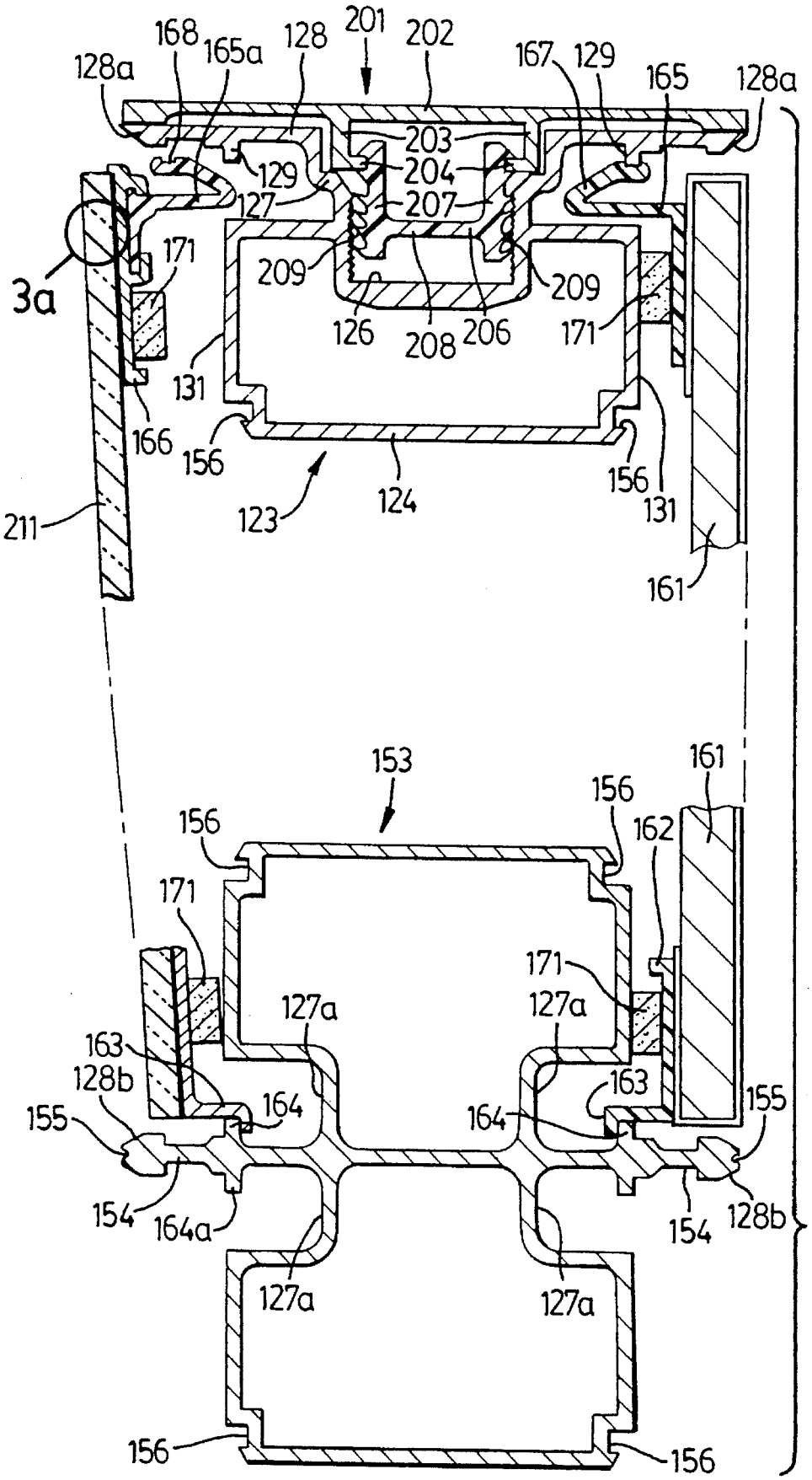
FIG. 3 is a partially fragmentary cross-section through a frame element as in FIG. 2 employed in forming a window in the structure of FIG. 1, and taken on the line 3—3 in FIG. 1.
Figure 4:
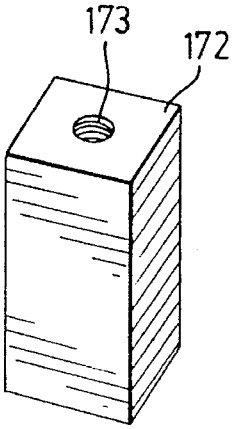
Figure 5:
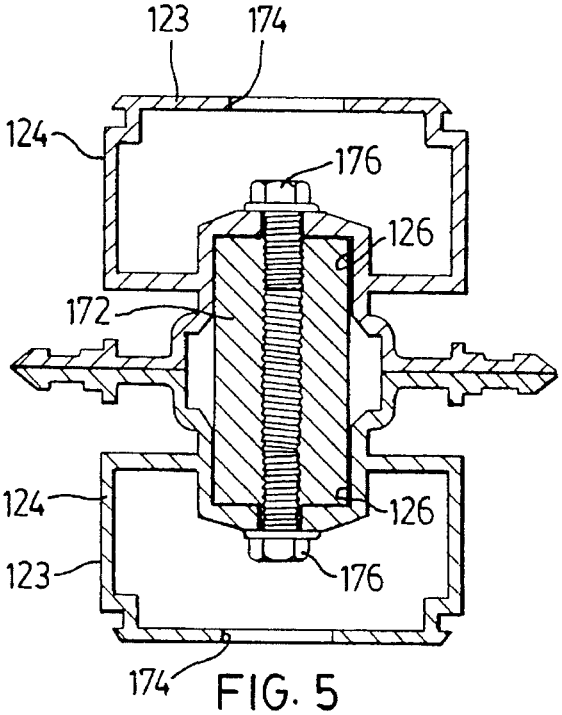
Figure 3A:
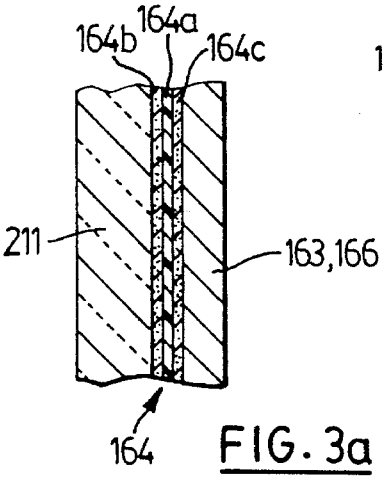
Figure 6:
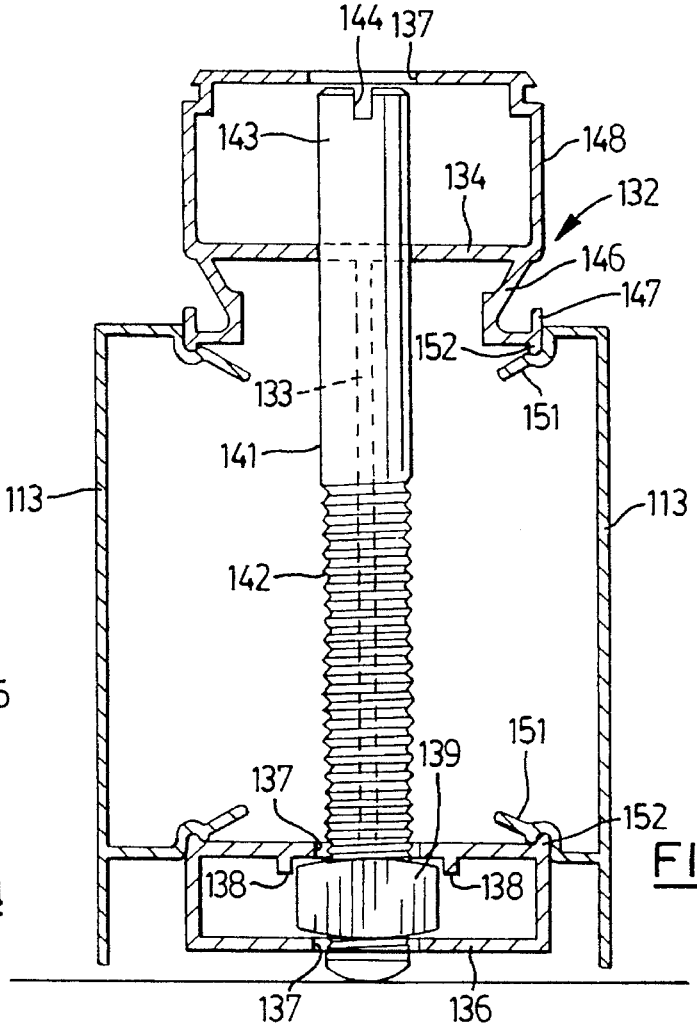
Figure 8:
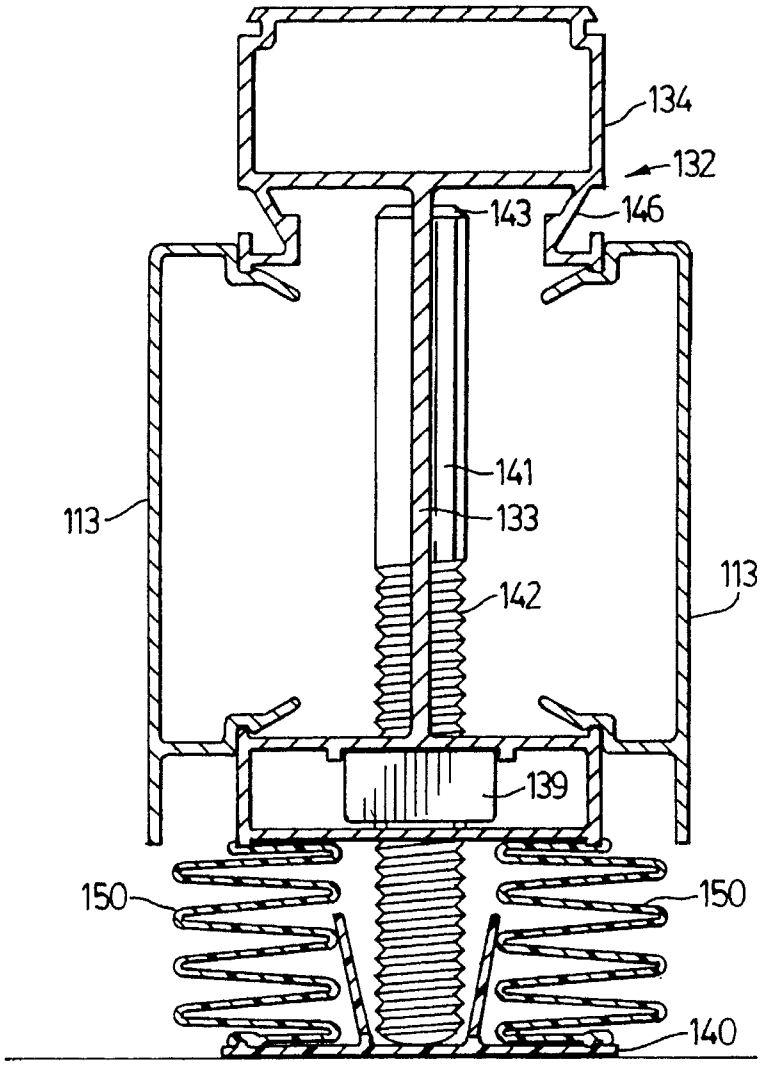
Figure 7:
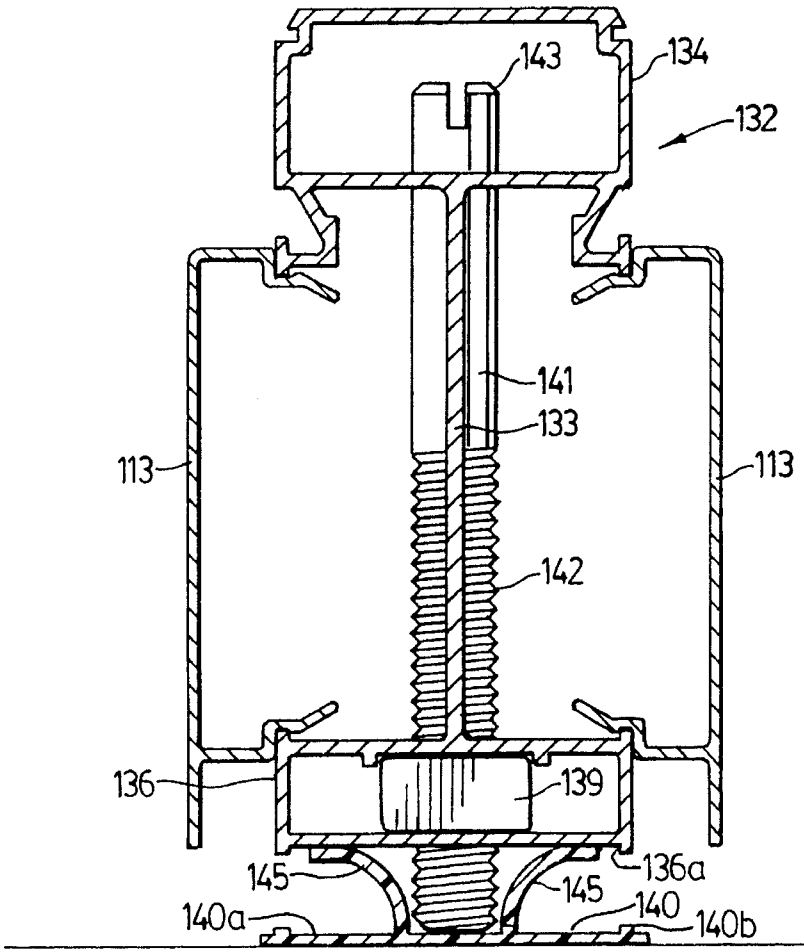
Figure 10:
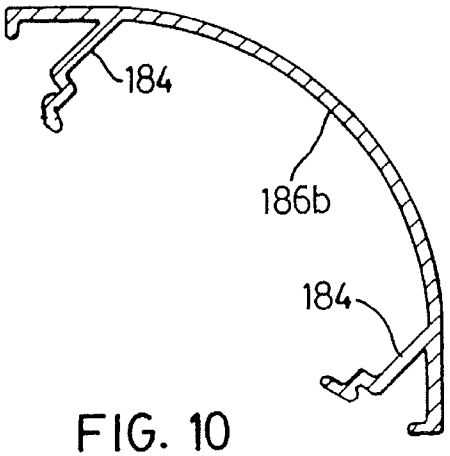
Figure 9:
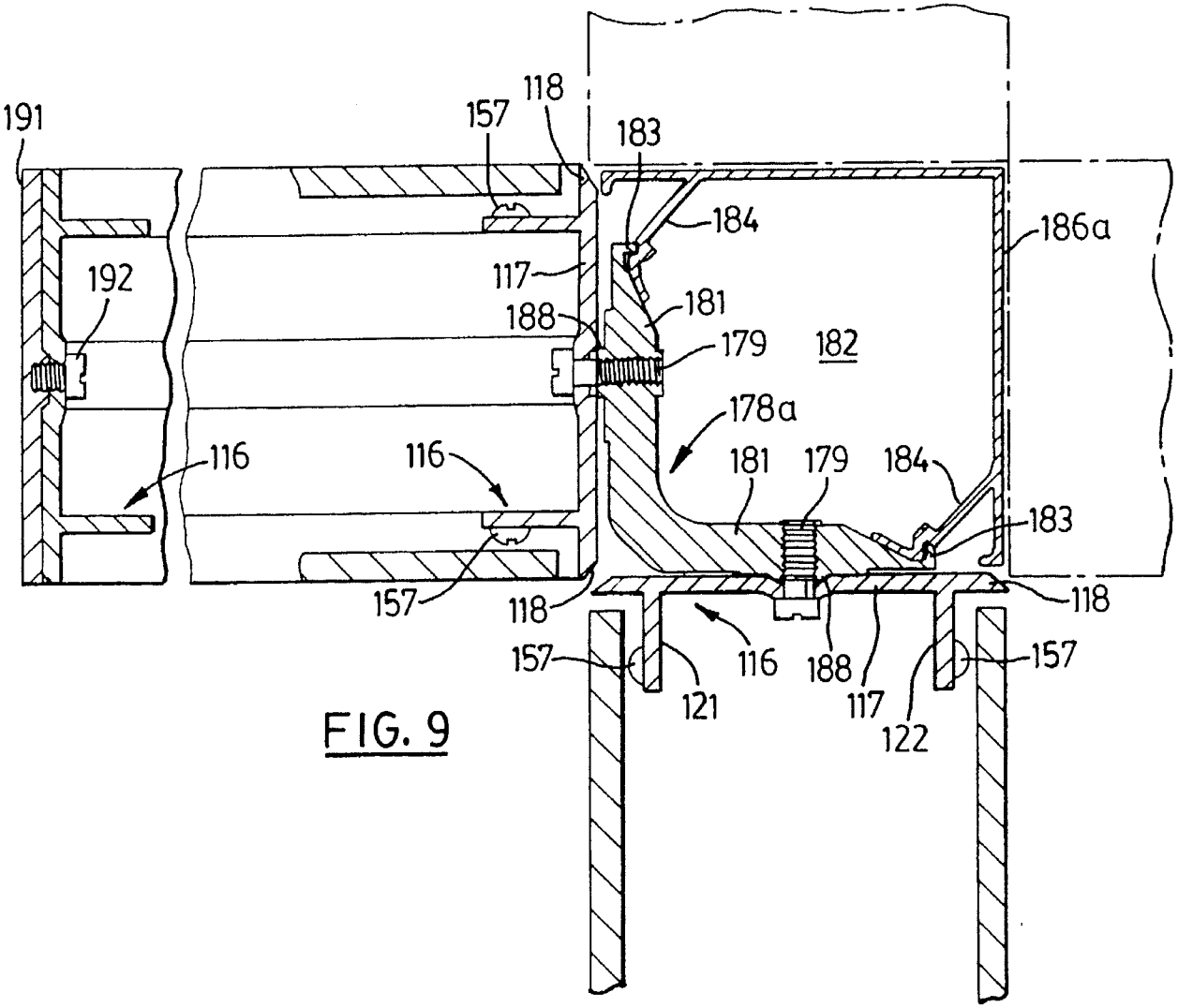
Figure 11:
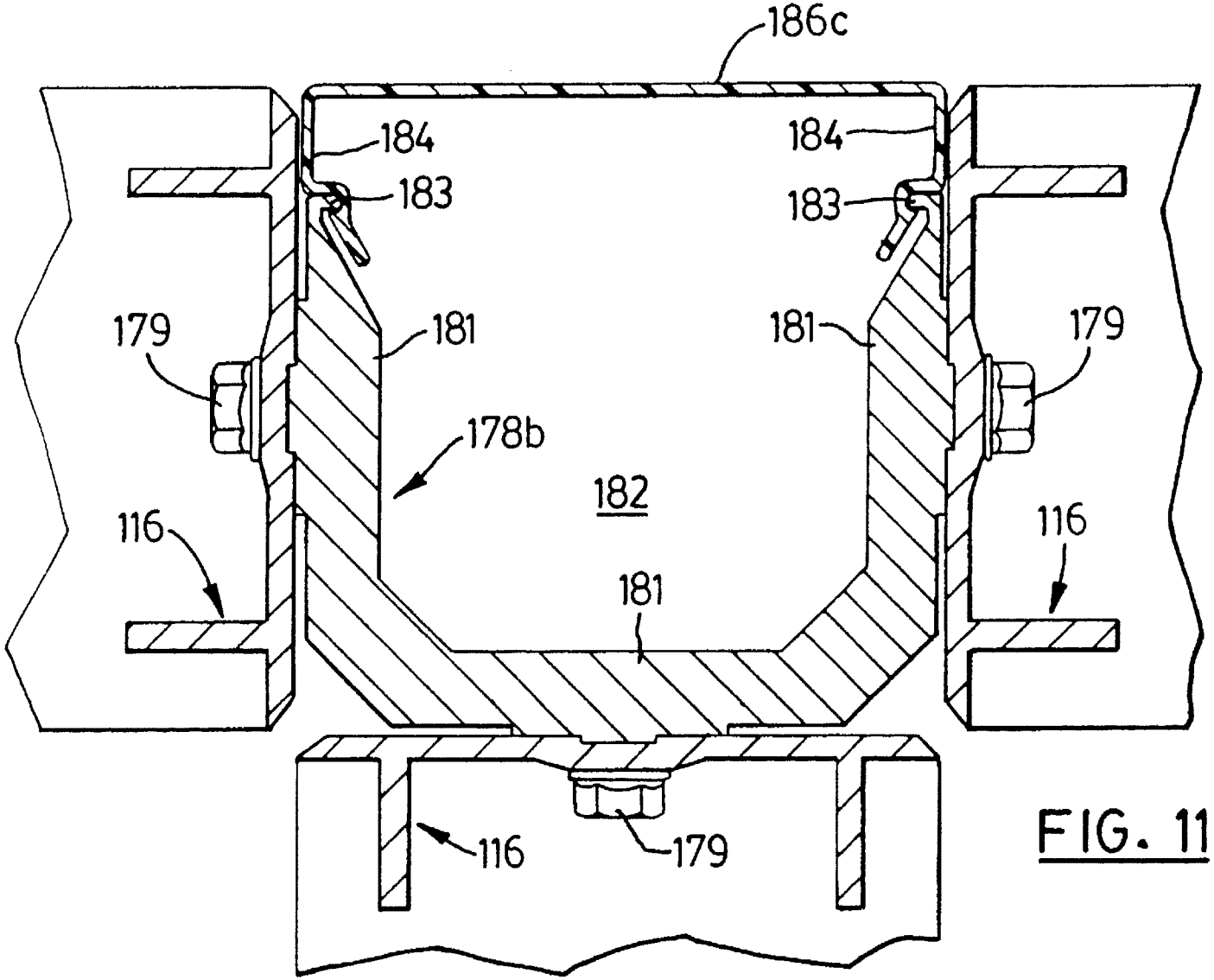
Figure 12:
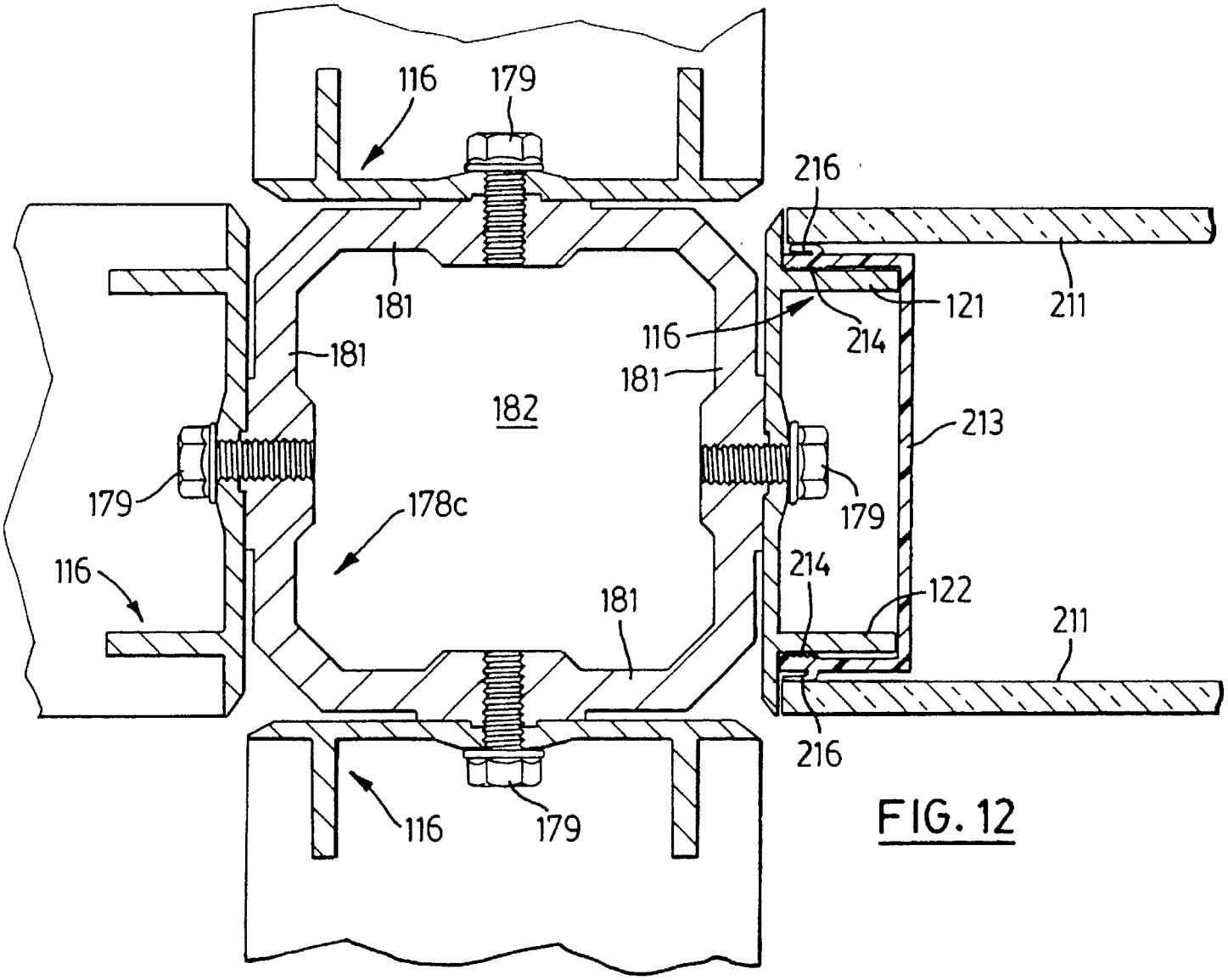
Figure 13:
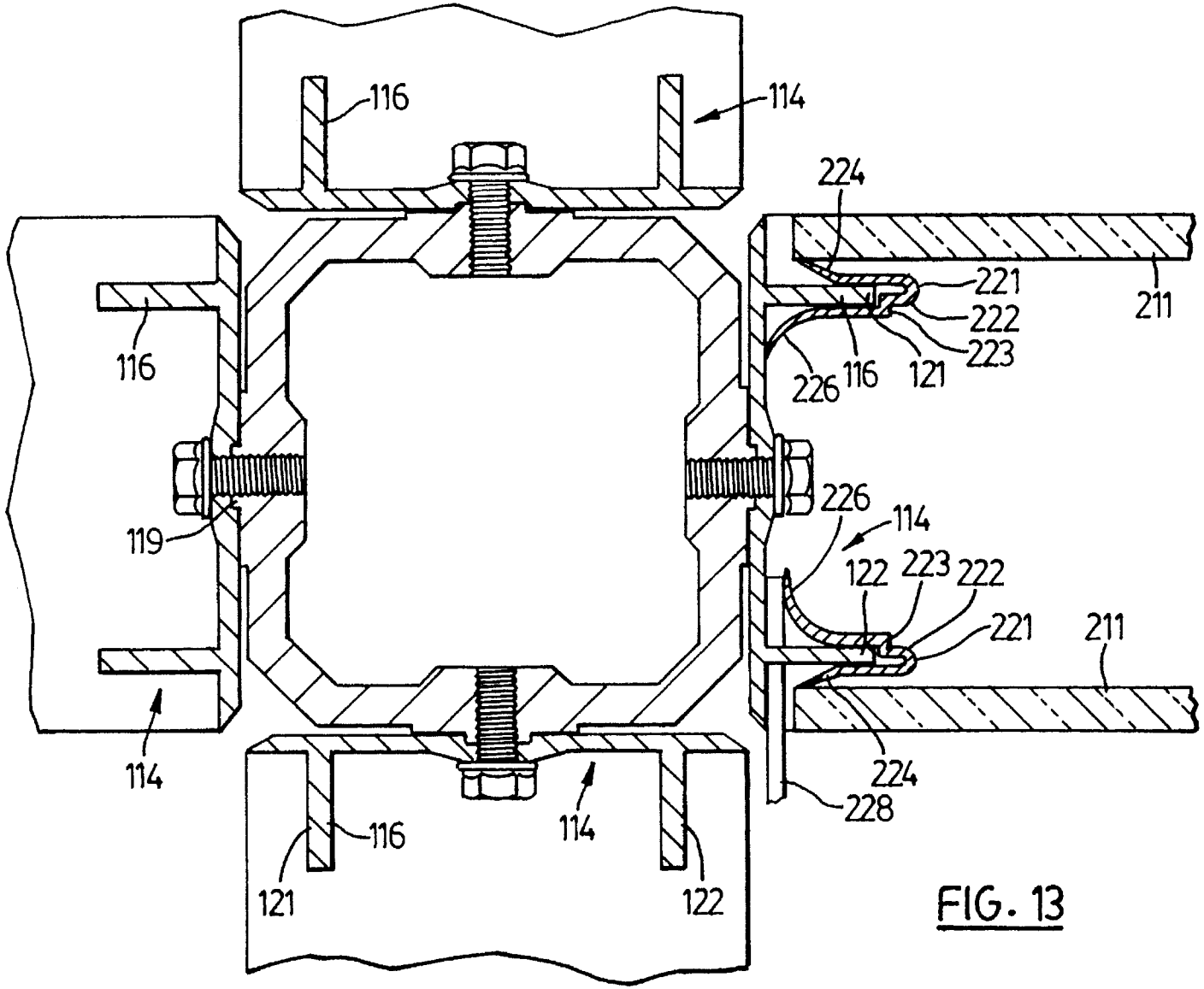
Figure 14:
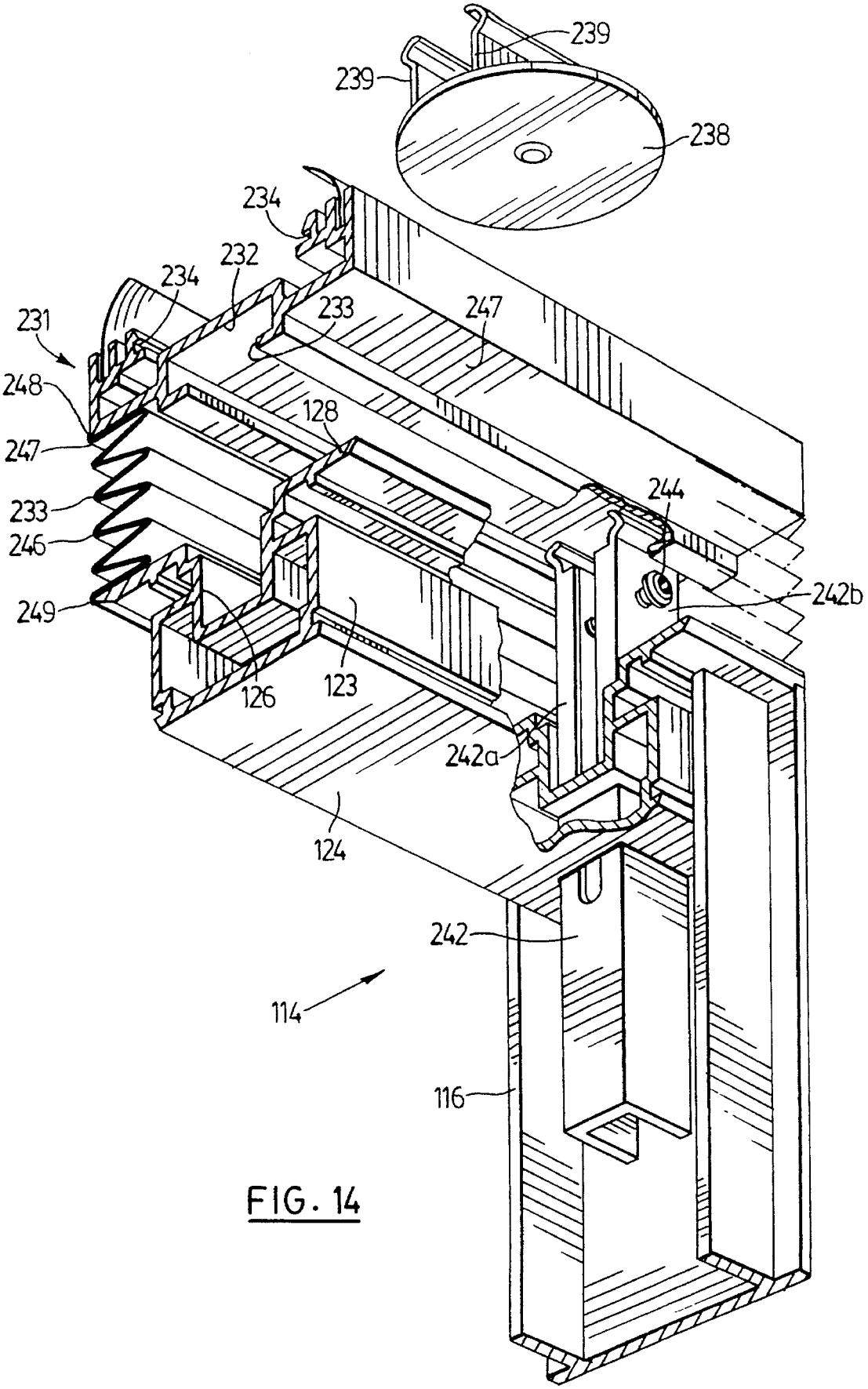
Figure 15:
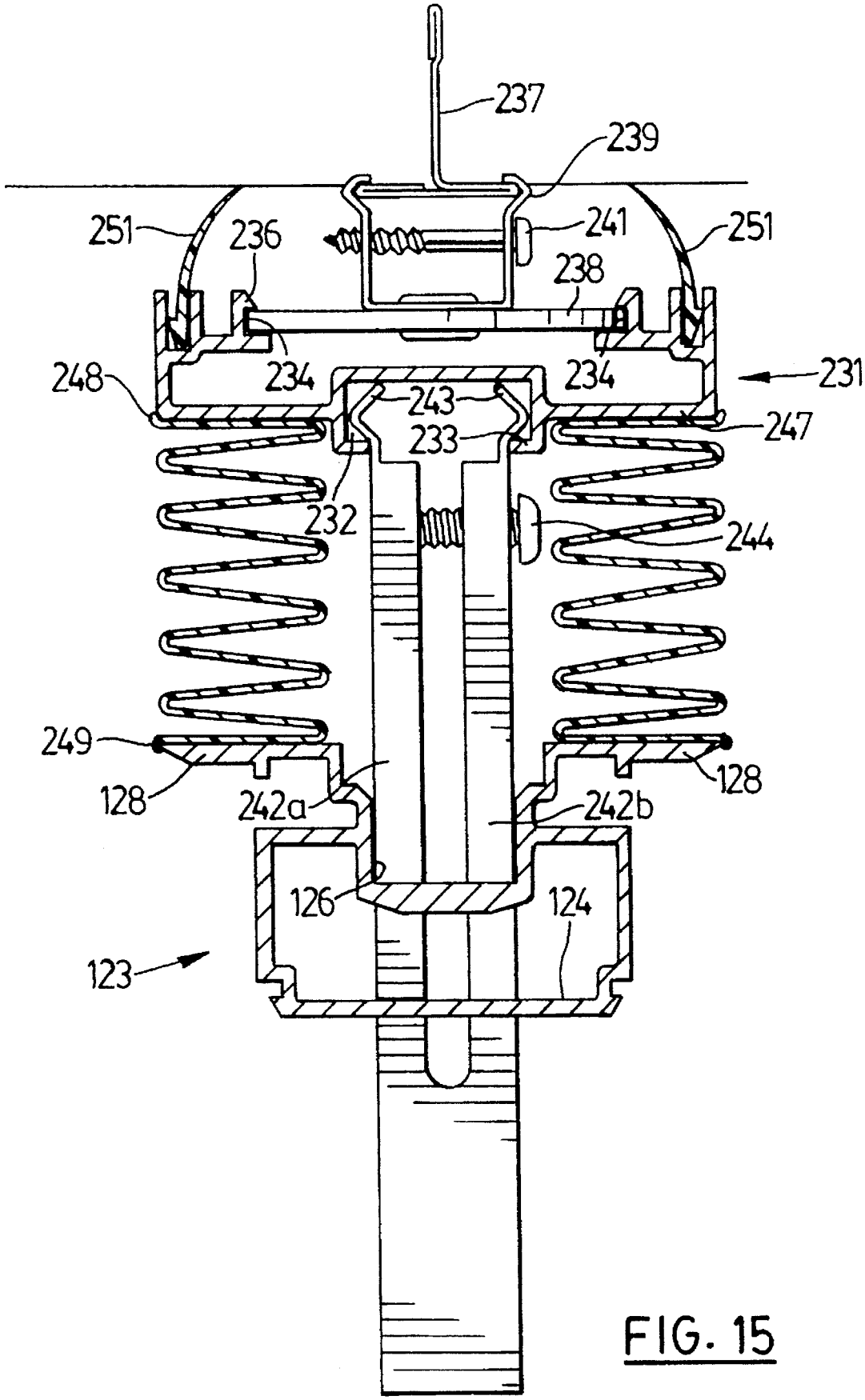

FIG. 3*a* is an enlarged cross-sectional view of the area circled at 3*a* in FIG. 3;

FIG. 4 shows one form of an interconnector member for interconnecting modular frame elements one on top of another;

FIG. 5 shows the interconnector member of FIG. 4 in use and is taken in vertical cross-section on the line 5—5 in FIG. 1;

FIG. 6 is a partial vertical cross-section through a lower horizontal rail of a partition structure taken along the line 6—6 in FIG. 1;

FIGS. 7 and 8 are views partly in cross-section corresponding to FIG. 6 and showing arrangements for concealing the lower ends of a leveller bolt;

FIG. 9 is a horizontal section taken on the line 9—9 in FIG. 1, showing a corner connector and a snap-on extruded cover;

FIG. 10 is a horizontal cross-section of a modified snap-on cover;

FIG. 11 shows a horizontal cross-section through a corner forming a T-joint;

FIG. 12 shows a horizontal cross-section through a corner forming a cruciform joint;

FIG. 13 is a horizontal cross-section corresponding to FIG. 12 showing a modified form of cover and seal for glazed partitions;

FIG. 14 is a partially fragmentary perspective view from below of an upper quadrant of a frame element in the area circled at 11 in FIG. 1, showing arrangements for connection of the partition structure to a ceiling; and FIG. 15 is a partial vertical cross-section through the frame element of FIG. 14.

Referring to the drawings, wherein like reference numerals refer to like parts, FIG. 1 shows an angled or corner unit consisting of two sections 111 and 112 joining at a right angle. Each section consists of two sub-sections, 111*a* and *b* and 112*a* and *b*.

Figure 2:
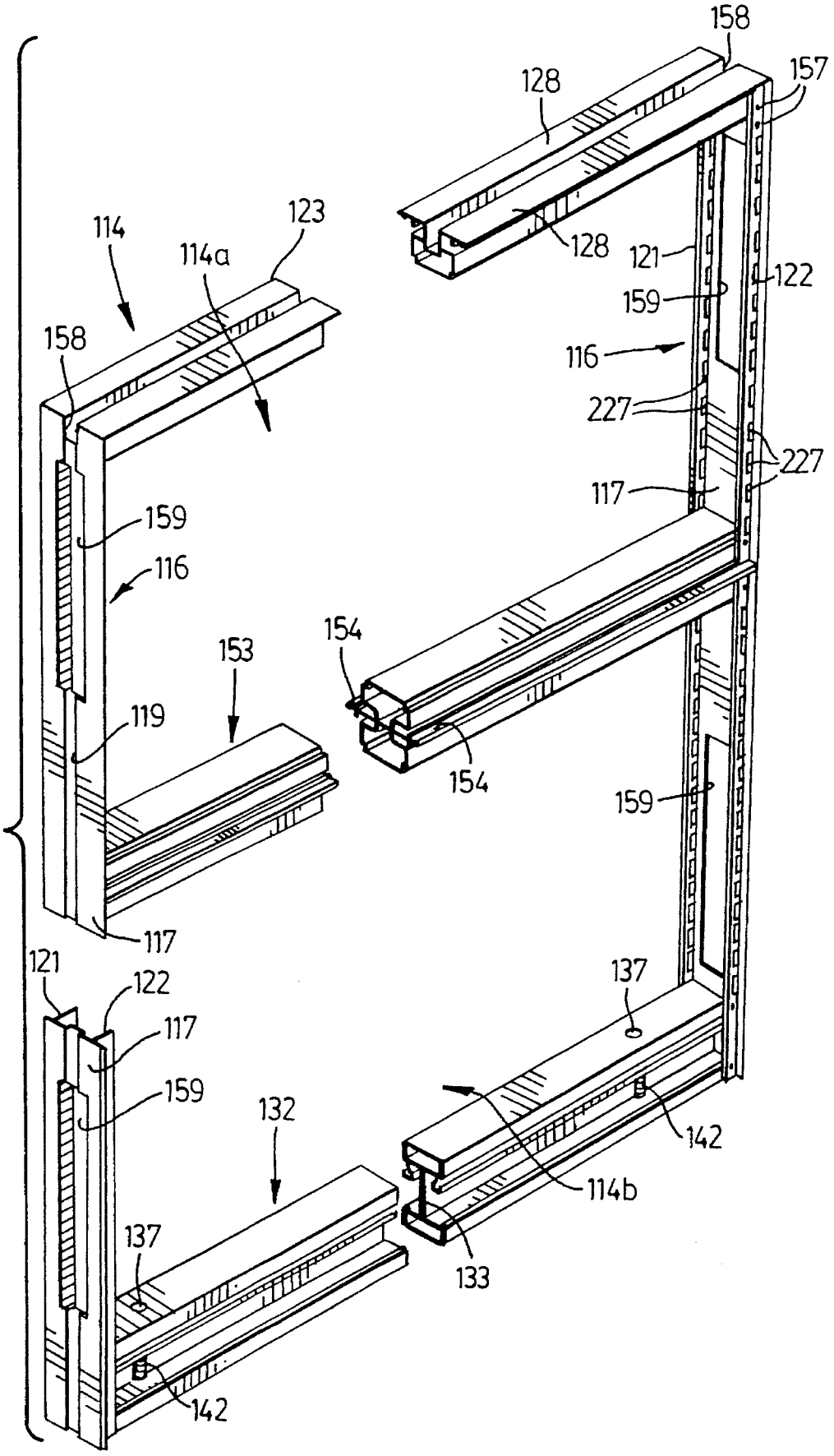
FIG. 2 is a partially fragmentary perspective view of one form of rectangular frame element used in the structure of FIG. 1.

The sub-sections are made up of assemblies of rigid modular rectangular frame elements on which facing panels, plates, capping plates and like finishing elements are connected. Some of these frame elements are intended for positioning at upper levels. Others are intended for positioning in contact with the floor or other supporting surface and are base units having provision for attachment of a baseboard plate 113. FIG. 2 shows a base unit 114 which constitutes the structural support of, for example, the partition sub-section 112*b*.

The element 114 comprises two continuous side rails 116 part of one of which is shown cut away in FIG. 2, to illustrate the section of the rail. The cross-section is also seen in each of FIGS. 9 and 11 to 13, and consists of a plate 117 with edges 118 which are preferably bevelled as seen in FIGS. 7, 9 and 10, a narrow central rectangular groove 119, and spaced rearwardly directed flanges 121 and 122. Desirably the rails 114 and all other continuous rails employed in and together with the frame elements are formed by extrusion. Preferably they are aluminum extrusions, but it will be appreciated that other metals or high-strength plastics materials may also be employed.

The element 114 has an upper continuous rail 123, the cross-section of which is best seen in FIG. 3. It is in the form of a generally rectangular box section 124 formed with a channel section recess 126 in its outer side. Each wall of the recess 126 connects through a transition section 127 to an outwardly directed edge flange 128 having a bevelled end edge 128*a*. There is an inwardly directed rib 129 aligned with each outer side 131 of the box section 124. The ribs 129 and outer sides 131 together define inwardly-directed lips on which panels can be connected in a manner to be described in more detail later.

A continuous bottom rail 132 of the element 114, as best seen in cross-section in FIG. 6, is of generally I-shape, and offers a channel facing each side of the element 114. It has a vertical web 133. FIG. 6 shows the beam 132 housing a levelling arrangement. The beam 132 is formed integrally with a box section 134 and 136 at its upper and its lower ends. At points where the levelling means are to be disposed, openings 137 are formed through the inner and outer sides of each of the box sections 134 and 136 and in the central web 133 of the I-beam. The lower box section 136 is formed with parallel ribs 138 non-rotatably capturing a flat sided nut 139. The lower side of the box section 136 projects horizontally inwardly to support the nut 139. The nut 139 has a threaded opening in which is threaded a stud 141 with a threaded shank 142 and a head 143 with a slot 144 having planar vertical surfaces so that the head 143 can be rotated to raise or lower the stud 141 relative to the beam 132, and thus extend or retract the lower end of the stud to effect levelling. Normally the head 143 of the stud 141 is housed within, or below the upper side of, the box section 134 so that it does not interfere with cables or wiring running within the frame element.

It will be noted that the upper outer side of the I-beam 132 is formed with an inwardly directed flange 146 terminating in an end flange 147 parallel to the side 148 of the upper box section 134. The recess provided by the flanges 146 and 147 provides a slot which can receive a hook-shaped plate for attachment of a facing panel in the manner to be described below.

FIG. 6 also shows the extruded resilient baseboard cover plates 113 provided with rearwardly inwardly directed flanges 151 having groove formations for snap coupling between inwardly directed flanges 152 formed on the lower and upper side regions of box sections 134 and 136, respectively.

FIGS. 7 and 8 show modified versions wherein an extruded plastics floor rail 140 is employed. The base portion 140*a* of the rail 140 may be attached to the floor, for example by gluing or nailing. Resiliently flexible wing portions 145 are extruded integrally with the rail 140. The wings 145 incline outwardly and are spaced apart sufficiently to receive the free end of the threaded shank 142 therebetween, so that normally they conceal the free end of the shank 142 as seen in FIG. 7, while the free ends of the wings 145 bear on and are deflected outwardly by engagement with the underside of the box section 136.

Where the floor is very uneven or has a strong slope and there are areas in which there is a large gap between the rail 132 and the floor, a horizontally pleated plastics filler strip 150 may be applied on each side of the partition, as seen in FIG. 8. The strip 150 is compressed between and frictionally engages the side edges of the base portion 140*a* of the rail 140 and the bottom of the box section 136. In order to assist in retaining the filler strip firmly in place, each edge of the strip 150 may be formed with a longitudinally extending groove which receives correspondingly shaped ribs 136*a* on each lower side edge of the box section 136 and 140*b* on each edge of the base portion 140*a*.

The element 114 is provided with a hollow central cross beam 153, which as best seen in FIG. 3 is of a unitary cross-section corresponding approximately to that obtained by placing together two of the extrusions 123 in inverted relationship. On each side, therefore, it has flanges 154 which are twice the thickness of the flanges 128, and the central portion of the beam 153 is of a narrow waisted configuration, defined by re-entrant transition sections 127*a*, which define recesses adjacent the upper and lower sides of each flange 154. Each flange terminates in a double-bevelled end portion 128*b* provided with a central groove 155 on its outer end, so that the upper portion of the end 128*b*, the sides of the rails 116 and the edges of the flanges 128*a* of the rail 123 define a rectangular framing line. The inner end of the box section 124 of the rail 123, and the corresponding portion of the beam 153 may be formed with square section recesses 156 onto which may be snap coupled resiliently deflectable wings of extruded plastic cable carriers.

In assembling the frame element 114, the ends of the cross rails or beams 123, 132 and 153 are butted to the inner sides of the side rails 116, between the flanges 121 and 122, and the sides of such cross beams or rails which fit snugly between the flanges 121 and 122 are secured with fasteners 157 such as self-tapping screws or rivets passed through holes in the flanges 121 and 122. Preferably, as seen in FIG. 2, the flanges 154 of the hollow cross-beam 153 are notched at each end to receive the flanges 121 and 122. At the upper end of each side rail 114, the flanges 121 and 122 are notched so that the flanges 128 of the rail 114 run out to the side of the frame element. The upper end of each plate 117 is notched to provide a recess or recesses, for example as shown at 158 in FIG. 2, so that electrical cables may be run into the frame element from the exterior.

The side rails 116 are also formed with cut outs, such as, for example, the cut outs 159, through which cables or other service conduits can be introduced into or run through the interior of the element 114.

It will be noted that the side rails 116 are of the same width as the flanges 128 on the rail 114 and the flanges 154 on the cross beam 153, so that on each side of the element, the edges of the flanges 128 and 154 are coplanar with the edges of the rails 116 and form a thin peripheral frame or border around the rectangular opening 114*a* defined in the upper part of the element 114 and around at least three sides of the lower opening 114*b*.

In use, facing panels such as panels 161 may be attached to the frame element 114 to enclose the open sides of the element and provide a partition structure in the form of a rectangular box-like housing. In the preferred form, a standard size of panel 161 is employed to cover both the upper and the lower openings 114*a* and 114*b*. The panel 161 fits closely into the upper opening 114*a*, leaving a small clearance between its edges and the edges of the flanges 128 and 154 and side rails 116.

As noted above, sub-section 112*b* shown in FIG. 1 may be formed by a base frame element 114 together with panels 161 and plate 113. For ease of reference, the element 114 may be referred to as a "two high base unit" since each side may be clad with two of the panels 161 and the plate 113. To form a higher unit, such as sub-section 112*a*, a rigid rectangular frame element may be stacked on top of a base element 114. Such frame element is preferably dimensioned so that it can be clad with a single standard-sized panel 161 on each side, and is therefore conveniently referred to as a "one high unit". The frame element of such one high unit comprises side rails similar to the side rails 116 in FIG. 2, and upper and lower channel section rails joined thereto and formed of the same extrusion as the rail 123, these rails being disposed in inverted relationship to one another.

Still taller units, such as the sub-sections 111*a* and 111*b* can be formed by stacking a further one high unit on a partition structure such as that of sub-section 112*a*. Alternatively, a "three high base unit" may be provided of similar construction to the elements described above but dimensioned so that it may be clad on each side with three of the standard panels 161 and a plate 113. It consists of side rails 116, a bottom rail 132, first and second hollow cross beams similar to the beam 153 and spaced at intervals corresponding to the spacings of the beam 153 and rail 132 as seen in FIG. 2, and, as the uppermost horizontal member, a rail similar to rail 123. A one high unit may then be stacked on the three high base unit to form the units 111*a* and 111*b*. Other arrangements are possible such as "two high unit" stacked on a two high base unit.

The panels 161 are held onto such frame elements by a secure tamper-resistant catch mechanism illustrated in FIG. 3. Adjacent each side of the lower edge of the panel a small rectangular plate 162 for example of extruded aluminum or plastic, is attached as by an adhesive or with mechanical fasteners, and has a rearward flange forming a hooklike projection 163. When the panel is to be applied on a cross beam 153, the projection 163 may be hooked on an upper lip flange 164 on the flanges 154. When attached to lower I-beam 132, the projection may be hooked on the flange 147. When hooked on a one high unit, the projection may be hooked on the flange 129 of a lower rail of the unit similar to the rail 123.

The lower edge of each panel 161 is thus prevented from being pulled away from the element 114 by a direct outward pull on the edge of the panel, but is free to pivot or rock about the projection 163 or the flange to which the projection is attached.

Adjacent each side of the upper edge of the panel 161 a piece of a generally L-section resilient, preferably plastics material, extrusion 165 is fastened or adhered. Alternatively as shown in FIG. 3, left hand side a similar extrusion 165*a* may be located within a rectangular channel section keyway 166 with re-entrant lips, secured with adhesive or fasteners. A generally U-shape tongue 167 extends rearwardly and is formed on its outer side with a rectangular channel 168 forming two opposing shoulders of width to snugly receive the edge of the flange 129 in the case in which the upper edge of the panel is applied to a rail 123, or the edge of a lower lip flange 164*a* on the flange 154 of the beam 153.

In each case, the tongue 167 resiliently engages the shoulders of its flange 129 or 164*a* when the upper end of the panel 161 is pressed home. The panel edge is thereby securely held against disengagement from the frame element when an outward pull is applied to the edge. As noted above, the panels 161 are held on their respective frame elements with only a small clearance between their edges and the adjacent frame sides, and the free ends of the tongues 167 are practically indiscernible unless the edges of the panels are very closely inspected.

In order to free the panel from its mounted position, a thin-bladed tool such as a putty knife may be inserted through the clearance adjacent the panel edge in order to apply inward pressure on the tongue 167, deflecting it resiliently inwardly, so that the channel 168 is freed from the edge of the slot. The panel edge can then be rocked outwardly about the pivoted connection provided by the hook 163 allowing access to electrical equipment within the partition or if desired the panel can be lifted to free the hook 163 from its engagement, thus allowing the panel to be removed and replaced, A resiliently compressible sealing or gasketing strip 171, for example of resilient plastic foam, is preferably applied, for example using its own tacky adhesive coating, on the inner sides of the extrusions 165 and 162, in positions such that the strips 171 will be compressed against the outer sides of the rails 123 and beams 132 or 153 in the closed positions of the panels 161. If made continuous along the width of the panels 161, the strip 171 may seal the horizontal gap between the panel 453 and the horizontal rails or beams of the frame element. The strip 171 biases the panel 161 outwardly, thus preventing any tendency for the panel 161 to rattle in its mounted position.

The hook formations 163 at the lower edges of the panels, and the catch formations 165 and 166 at the upper edges of the panel may extend continuously along the length of each panel.

Referring to FIGS. 4 and 5, these show an arrangement for connecting a frame element having a rail 123 along one side, such as a one high unit as described above or the like, on a frame element having an upper rail 123, such as a two high base unit as shown in FIG. 2, or the like one high or three high unit as described above. A rectangular section block 172 has a threaded bore 173 therethrough. At the points at which interconnections are to be made, openings 174 are drilled or otherwise formed through the inner wall of the box-section 124 and through the bottom of the channel 126. A block 172 is placed at each point and a bolt 176 threaded upwardly into the lower end of the bore 173 and tightened up with a tool introduced through the lower opening 174, so that the head of the bolt engages the underside of the channel bottom. The upper frame element can then be applied and a similar bolt 176 introduced and tightened through the upper opening 174.

In assembling a partition structure such as shown in FIG. 1, vertically adjacent frame elements such as the units 114 are preferably held together using connector members such as shown in FIGS. 4 and 5. Horizontally adjacent frame elements are preferably held together with simple mechanical fasteners such as nuts and bolts passed through holes drilled through the side rails 116 of adjacent elements.

Where it is desired to form an angle between two horizontally adjacent elements, for example as shown in FIGS. 1 and 9, connector elements such as shown in FIGS. 9 and 11 to 13 are used. The connectors 178*a*, 178*b* and 178*c* shown are formed from short lengths severed from extrusions. They are connected to the side rails 116 of the frame elements with screws 179 passed through holes drilled through the side rails 116 and through the connectors 178*a* to *c*. Such lengths of connector 178*a* to *c* are connected to the outer sides of the side rails 116 at vertical intervals, for example of about 200 cm., in order to provide an adequately rigid and strong corner connection. The connectors 178*a* to *c* comprise arms connected together at right angles and connectors 178*a* to *c* have arms 181 which join together adjacent the side edges of the side rails 116. They therefore leave open a relatively large space 182 within the rectangular area defined by the intersection of the side rails 116 projected outwardly, so that wiring can be passed freely upwardly along the outer sides of the side rails 116. The space 182 can accommodate cables or electrical connectors of larger cross-section than is possible with the known arrangements.

FIGS. 9, 11 and 12 show connectors 178*a* to *c* of angle section, U-section and square-section, respectively, for forming corresponding corner structures or T-section or cruciform section corner arrangements.

The connectors 178*a* to *c* have the outer edge of each arm 181 having a free end is formed with a snap coupling formation, in this instance a re-entrant rib 183, which can more securely snap couple with corresponding grooves formed on rearwardly directed wings 184 formed on extruded resilient covers 186*a*, *b* and *c* shown in FIGS. 9, 10 and 11. Lengths of such covers 186*a* to *c*, which may be of, for example thin extruded aluminum or resilient plastic, are applied to the outer sides of the frame elements at the corner to conceal the outer sides of the side rails 116, corner connectors 178*a* to *c*, and any vertically extending wiring. FIGS. 9 and 10 show right-angle section and convexly arcuate section covers 186*a* and *b* which may be applied at a right angled corner according to design requirements or preference.

The connection portions or arms 181 are formed with rectangular projections 188 which locate in the central rectangular grooves 119 in the outer sides of the side rails 116 so that the connectors 178*a*, *b* and *c* are retained against lateral movement relative to the rails 116.

As seen in FIGS. 1 and 9, the outer ends of the partition structures may be capped with a vertical finishing plate 191 preferably an aluminum extrusion of the cross-section shown, which is screwed to the outer side of the side rail 116, with screws 192 passed through openings drilled at intervals through the central portion of the rail 116.

As shown in FIG. 3, an extruded capping plate 201 comprises a flat plate 202 formed with two parallel walls 203 on its under side. Each wall has an inwardly directed edge flange 204 parallel to the plate 202. Co-extruded plastic connectors 206 are used to connect the plate 201 to the upper side of the rail 123. The co-extrusion 206 is mainly of a hard rigid plastic forming two spaced walls 207 connected by a yoke 208. In the upper end of the outer side of each wall 207 a groove is formed which receives a respective edge flange 204. Co-extruded on the outer sides of the lower portions of the walls 207 are upwardly and outwardly directed fins 209 formed from a soft resiliently flexible plastic.

In use, short lengths, e.g. of 3 cm, are severed from the co-extrusion 206 and are slid along the plate 202 with the grooves engaging the flanges 204 to be spaced at intervals, e.g. of 100 cm., along the length of the plate 202. The plate 202 together with the connectors 206 is then pressed downwardly into the channel 126 of the rail 123. The fins 209 are compressed inwardly and flex outwardly to resist withdrawal. The sides of the channel 126 may be finely serrated, as seen in FIG. 3, to improve the frictional grip of the fins 209.

FIGS. 3 and 12 show one example of an arrangement for connection of glass panels 211 on an opening of a frame element 123, whereby windows may be provided. As described with reference to FIG. 3 above, a length of a keyway extrusion 166 is connected along the upper edge of the glass panel 211, and a length of a hooked extrusion 163 along the lower edge.

The extrusions 163 and 166 may be adhered to the inner side of the glass 211 with glue or with double-sided adhesive tape 164 as shown in more detail in FIG. 3*a*, having a flexible middle layer 164*a* and an adhesive 164*b* on each side. U-shaped resilient catches 165*a* are provided in the keyway 166 at intervals so that the panel 211 may be attached to the upper and lower or intermediate rails 123, 132 or 153 in the manner described above with reference to FIG. 3. The keyway extrusion 166 may extend continuously along the edges of the panel 211 and the catch formations 165*a* may be in the form of short pieces cut from a continuous extrusion.

A gasketing strip 171 is applied along the entire width of upper and lower margins of the rear side of the panel, so that the horizontal gaps between the panel 211 and the cross rails 123, 132 or 153 are sealed.

In order to provide an attractive appearance to the glass panel 211, an opacifying layer may be applied along the upper and lower margins of the inner side of the glass panel in the regions indicated at 211*a* and 211*b* in FIG. 1. The opacifying layer may be a ceramic glaze-like coating which is baked or fired onto the glass.

The vertical gap between the side rails 116 and the panel 211 is sealed with a further gasketing arrangement one form of which is shown in FIG. 12. The gasket employs a co-extruded generally channel shape plastics member 213. The channel bottom and side walls of the member 213 are of relatively hard, stiffly flexible plastic and are spaced so that they bridge over and grip compressively on the outer sides of the flanges 121 and 122 of the side rail 116. Preferably, the inner side of each wall of the channel 213 is formed with raised ribs 214 which engage the flanges 121 and 122. These ribs 214 may be co-extruded with the channel and are of a softer plastic which tends to deform and to grip with greater friction on outer sides of the flanges 121 and 122.

The outer sides of the walls of the channel 213 each have co-extruded on them a soft, resiliently flexible fin 216 which normally extends outwardly at an acute angle from the side wall. In the closed position, as seen in FIG. 12, the panel 211 compresses the fin 216 inwardly so that this forms a gasket or seal pressing resiliently against the inner face of the panel 211.

As will be appreciated, normally a glass panel 211 is employed on each side of a glazed opening, and the gasketing strips and fins 171 and 216 can be employed to seal the opening in the frame element from the exterior by sealing the edges of each glass panel 211 to the vertical and horizontal rails. The gasketing therefore provides sound proofing and prevents ingress of dust to the interior of the glazed opening.

The rails used in the construction of the frame elements may be black anodized aluminum, or at least the inner sides of the horizontal rails or beams 123, 132 or 154 may be matt black coated or painted, and the channel 213 may be extruded from matt black plastic or may at least be painted or coated matt black on the exterior of the channel bottom, so that a neat matt black interior frame is visible through the glass panels.

FIG. 13 shows a further embodiment of an arrangement for gasketing the vertical gap between the glass panels 211 and the vertical side rails 116. A separate extruded plastics U-section cover 221 is applied over each flange 121 and 122. Preferably, each cover 121 is molded of stiffly resilient plastic and opposite limbs of the U grip compressively on opposite faces of the flange 121 or 122 to which it is applied. Preferably the inner end of each U-section has a reduced width portion 222 connected to the limbs of the U by an inward step 223 providing an outer surface extending transversely of the rail 116. On one side which is disposed facing the glass panel 211 each cover 221 has a resiliently flexible wing 224 inclining and tapering rearwardly outwardly, which in use is deflected inwardly slightly by contact with the glass panel 211, and forms a seal between the rail 116 and the panel 211. The wing 224 may be co-extruded with the U-section cover 221 and may be of a more softly flexible plastic than the body of the cover 221.

Each cover 221 is preferably provided with a rearwardly inwardly tapering and inclining wing 226, which may also be co-extruded of a softer plastic, which normally seals on the inner side of the rail 116 between the flanges 121 and 122. In the preferred form, each panel 211 is somewhat shorter than the horizontal internal between the vertical rails 116 of standard sized frame elements 114, so that there is a spacing between the vertical edge of each panel 221 and the adjacent rail 116. As seen in FIG. 2 each flange 121 and 122 is formed with an array of regularly spaced slots 227 whereby the hook shaped engaging formations of conventional shelf brackets may be engaged with the flanges 121 and 122 in order to support shelves or other items on the partitions. As seen in FIG. 13, when a shelf bracket 228 is inserted the wing 226 conforms to the inner end of the bracket 228 except for small gaps which do not impair the sound proofing of the partition.

FIGS. 14 and 15 show an arrangement for connecting the upper end of a frame element 114 to a ceiling. Along the line of the intended position of the top of the partition structure, an extruded ceiling rail, for example as shown in FIGS. 15 and 16 by reference numeral 231, is connected. The rail 231 comprises a downwardly facing channel 232 with re-entrant edge flanges 233. The upper side of the rail 231 has inwardly facing opposing grooves 234, the upper sides of which are formed by a rib 236 with an inwardly downwardly inclining surface. For attachment to a suspended ceiling having inverted T-bars 237, a clip is provided comprising a disc 238 connected to jaws 239 having indentations for engaging opposite edges of the T-bar 237 and a screw 241 or other jaw adjusting means for clamping the jaws 239 on the bar 237. With the arrangement illustrated, discs 238 are connected at intervals along the T-bar 237 and then the edges of the discs 238 are snapped into the upper side of the rail 231 between the grooves 234 as seen in FIG. 15. Other means may of course be employed for connecting a rail 231 to a ceiling.

Adjacent the side rail 116, the frame element 114 is provided with a vertically slidable latch bar 242, in this example a length of square channel section extrusion, the upper end of which is bifurcated to provide first and second limbs 242*a* and 242*b*. Each limb is formed with a laterally outwardly projecting portion 243 at its upper end.

A screw 244 for laterally biasing the limbs 242*a* and 242*b* apart engages a threaded opening in one limb 242*b* and its free end engages an inner side of the opposite limb 242*a*. The lower end of the bar 242 passes with a small clearance between the channel sides of the recess 12*b* in the upper rail 123 and through rectangular notches in the end of the rail 123 formed in the lower wall of the box 124 and the bottom of the channel 126.

In use, the partition structure is assembled usually flat on the floor and the bars 242 are inserted at intervals, each at a longitudinal end of a frame element 114 with the bar 242 passed through the rail 123 to a retracted position in which the upper ends of the limbs 242*a* and *b* are disposed in the upper end of the channel 126. The assembled partition is then rocked upwardly to a position underneath the rail 231 and the bar 242 slid upwardly to engage the projections 243 within the downwardly facing channel 232 of the rail 231 as seen in FIG. 15. The screw 244 is then turned to urge limbs 242*a* and *b* apart in order to wedge the projections 243 within the channel 232 and resist withdrawal from between the re-entrant flanges 233. The urging apart of the limbs 242*a* and *b* also tends to engage their opposite sides within the channel 126 in the rail 125 so that the frame element 114 is connected in a stable and rattle-free manner to the ceiling construction.

To cover the gap between the upper side of the partition and the rail 231, a resiliently compressible bellows-like filler strip 246 similar to the filler strip 150 is applied between the two members. The strip 246 comprises a horizontally pleated member extruded from resilient plastic. The strip 246 has its width less than the gap to be filled so that the upper and lower webs of the strip 246 are engaged compressively by an edge flange 247 of the rail and the flange 128 of the rail 123, and are retained in place by friction. The upper and lower edges of the filler strip are formed with short edge flanges 248 and 249 which engage the outer edges of the flanges 247 and 128 and limit insertion of the strip 246 as it is pressed inwardly into the gap, so that the strip aligns neatly with the edges of the rails 123 and 231.

In order to cover the gap between the ceiling structure and the rail 231 and to assist in soundproofing each edge of the upper side of rail 231 may be provided with a soft resiliently deflectable gasketing strip 251 preferably tapering upwardly in cross-section as shown which engages on the underside of the ceiling.

Modifications may of course be made to the structure described in detail above. For example in place of the rail 231 and attachment clips 238 and 239, a rail similar to the capping plate 201 shown in FIG. 3 may be attached to the ceiling. In this case the projection 243 of the bar 242 may engage within the channel 203.

I claim:

1. Partition structure adapted to be connected to a ceiling, comprising:

(a) a ceiling rail adapted to be connected to a ceiling and having a downwardly facing channel;

(b) a rectangular frame element adapted to be aligned beneath the ceiling rail, and formed by two vertical side rails, and upper and lower horizontal rails, a latch bar elongated in a vertical direction supported for vertical sliding movement adjacent one of said two vertical side rails between a lower position and an upper position extended above the upper horizontal rail wherein the channel of the ceiling rail receives an upper end of the latch bar, and wherein the frame element exposes an opening through which the latch bar can be manipulated to slide it from said lower to said upper position, and including means operative to prevent retraction of the latch bar from the channel of the ceiling rail; and (c) a resiliently compressible filler strip adapted to be lodged in compression between said upper horizontal rail and said ceiling rail;

and wherein said upper end of the latch bar comprises first and second engagement members and laterally adjustable biasing means for urging the engagement members from a laterally contracted position wherein the engagement members pass freely into the channel in the ceiling rail and a laterally expanded position wherein the engagement members engage opposite channel sides of said ceiling rail and resist withdrawal therefrom.

2. Partition structure as claimed in claim 1 in which the channel of the ceiling rail comprises re-entrant edge flanges and the upper end of the latch bar is adapted to be received snugly between said edge flanges.

3. Partition structure as claimed in claim 1 in which said upper horizontal rail is a box section extrusion and the latch bar slides with a snug fit in apertures formed in upper and lower sides of the box section.

4. Partition structure as claimed in claim 3 in which said apertures are formed in an end of said upper horizontal rail adjacent said one of said two vertical side rails.

5. Partition structure adapted to be connected to a ceiling, comprising:

(a) a ceiling rail adapted to be connected to a ceiling and having a downwardly facing channel;

(b) a rectangular frame element adapted to be aligned beneath the ceiling rail, and formed by two vertical side rails, and upper and lower horizontal rails, a latch bar elongated in a vertical direction supported for vertical sliding movement adjacent one of said two vertical side rails between a lower position and an upper position extended above the upper horizontal rail wherein the channel of the ceiling rail receives an upper end of the latch bar, and wherein the frame element exposes an opening through which the latch bar can be manipulated to slide it from said lower to said upper position, and including means operative to prevent retraction of the latch bar from the channel of the ceiling rail; and (c) a resiliently compressible filler strip adapted to be lodged in compression between said upper horizontal rail and said ceiling rail;

and wherein the channel of the ceiling rail comprises re-entrant edge flanges and the upper end of the latch bar is adapted to be received snugly between said edge flanges, and said upper end of the latch bar comprises first and second engagement members each having a laterally outwardly projecting portion, and laterally adjustable biassing means for urging the engagement members from a laterally contracted position in which the projecting portions pass freely between the re-entrant edge flanges and expanded position in which the projecting portions engage the upper sides of said edge flanges and resist withdrawal therefrom.

6. Partition structure adapted to be connected to a ceiling, comprising:

(a) a ceiling rail adapted to be connected to a ceiling and having a downwardly facing channel;

(b) a rectangular frame element adapted to be aligned beneath the ceiling rail, and formed by two vertical side rails, and upper and lower horizontal rails, a latch bar elongated in a vertical direction supported for vertical sliding movement adjacent one of said two vertical side rails between a lower position and an upper position extended above the upper horizontal rail wherein the channel of the ceiling rail receives an upper end of the latch bar, and wherein the frame element exposes an opening through which the latch bar can be manipulated to slide it from said lower to said upper position, and including means operative to prevent retraction of the latch bar from the channel of the ceiling rail; and (c) a resiliently compressible filler strip adapted to be lodged in compression between said upper horizontal rail and said ceiling rail;

and wherein the upper side of said ceiling rail comprises laterally opposed inwardly directed grooves and including means for attachment of the ceiling rail to a ceiling comprising a disc adapted to have its edges snapped into said opposed grooves, and means for coupling the disc to the ceiling.

7. Partition structure as claimed in claim 6 wherein said means for coupling the disc to the ceiling comprise jaw members each having an indentation for engaging an edge of an inverted T-bar ceiling support, and jaw adjusting means for drawing the jaw members together to clamp on said edges.

8. Partition structure adapted to be connected to a ceiling, comprising:

(a) a ceiling rail adapted to be connected to a ceiling and having a downwardly facing channel;

(b) a rectangular frame element adapted to be aligned beneath the ceiling rail, and formed by two vertical side rails, and upper and lower horizontal rails, a latch bar elongated in a vertical direction supported for vertical sliding movement adjacent one of said two vertical side rails between a lower position and an upper position extended above the upper horizontal rail wherein the channel of the ceiling rail receives an upper end of the latch bar, and wherein the frame element exposes an opening through which the latch bar can be manipulated to slide it from said lower to said upper position, and including means operative to prevent retraction of the latch bar from the channel of the ceiling rail; and (c) a resiliently compressible filler strip adapted to be lodged in compression between said upper horizontal rail and said ceiling rail;

and wherein said filler strip comprises a horizontally pleated resilient plastics filler strip adapted to be compressed between and frictionally engage with an edge of the upper side of said upper rail and the adjacent edge of the lower side of the ceiling rail.

9. Partition structure as claimed in claim 8 wherein the upper and lower edges of the filler strip are formed with short edge flanges engaging on outer sides of the upper rail and ceiling rail, respectively.

* * * * *